US005752814A

United States Patent [19]

Starks et al.

[11] Patent Number: 5,752,814

[45] Date of Patent: May 19, 1998

[54] PLUNGER AND SEAL FOR WELL PUMP

[76] Inventors: Jimmy A. Starks, 1909 Palmetto Rd.; Billy J. Edwards, 215 Oak Ridge, both of Benton, La. 71006

[21] Appl. No.: 533,916

[22] Filed: Sep. 26, 1995

[51] Int. Cl.[6] ..... F04B 21/04

[52] U.S. Cl. ..... 417/554

[58] Field of Search ..... 417/56, 57, 58, 417/59, 60, 554, 553, 552; 92/87, 248

[56] References Cited

U.S. PATENT DOCUMENTS

| | | | |
|---|---|---|---|
| 1,548,805 | 8/1925 | Mowrey | 417/554 |
| 1,714,434 | 5/1929 | O'Bannon | 417/554 |
| 1,840,432 | 1/1932 | Bray | 92/87 |
| 2,583,111 | 1/1952 | Mardis | 417/554 |
| 3,915,602 | 10/1975 | Douglas | 417/554 |
| 4,345,766 | 8/1982 | Turanyi | 277/30 |
| 4,743,329 | 5/1988 | Hafa | 156/287 |
| 5,049,347 | 9/1991 | Magill et al. | 264/280 |
| 5,120,203 | 6/1992 | Priestly | 417/554 |
| 5,196,108 | 3/1993 | Wilmeth et al. | 205/243 |
| 5,255,294 | 10/1993 | Bierwirth | 376/204 |
| 5,344,678 | 9/1994 | Kajiwara | 428/34.4 |

*Primary Examiner*—Richard E. Gluck
*Attorney, Agent, or Firm*—John M. Harrison

[57] ABSTRACT

A plunger or traveling valve and seal for a well pump and an oil well pump in particular, which plunger includes a mandrel of selected length, at least one plastic sleeve fitted with at least one metal insert mounted on the mandrel for sealing the mandrel in a pump barrel and a ball and seat valve provided on at least one end of the mandrel. The plunger may include fiber rings and ring holders and is seated inside a conventional pump barrel and the plastic sleeve serves to seal the plunger as the plunger reciprocates in the barrel. The plastic seal is typically constructed of ultra-high molecular weight polyethylene with one or two flanged, typically brass, inserts tightly mounted in the plastic seal bore to control or limit thermal expansion in the plastic seal.

21 Claims, 4 Drawing Sheets

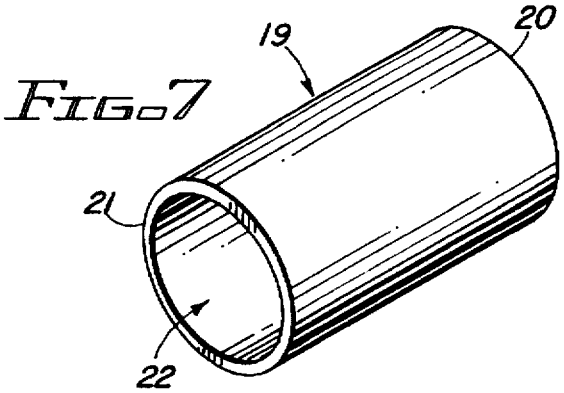
FIG. 7
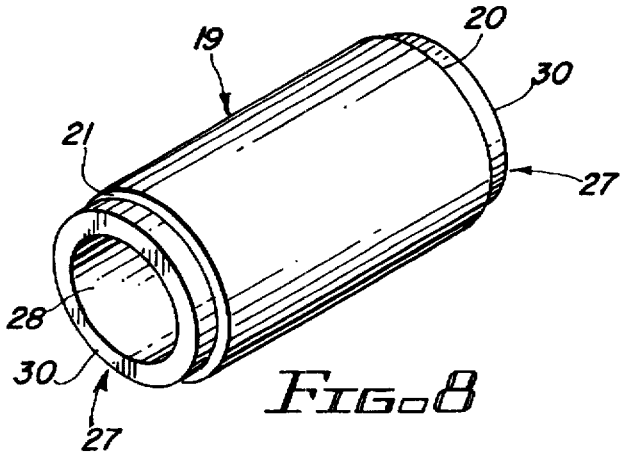
FIG. 8
FIG. 9
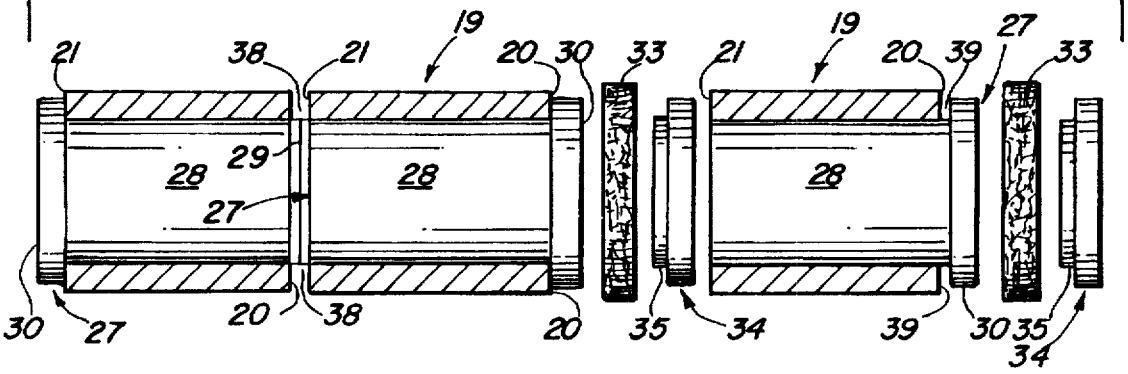
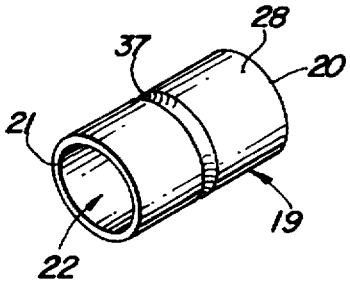
FIG. 10

PLUNGER AND SEAL FOR WELL PUMP

BACKGROUND OF THE INVENTION

1. Field of the Invention

This invention relates to downhole water and liquid hydrocarbon pumps and more particularly, to a plunger or traveling valve for an oil well pump, which plunger is fitted with a cylindrical plastic seal mounted on a metal insert or inserts that seal the plunger inside the pump barrel. In a preferred embodiment the plunger is characterized by a conventional or specially designed pump mandrel of selected length, material of construction and diameter and at least one plastic sleeve, fitted with at least one metal insert, mounted on the pump mandrel with at least one ball and seat valve attached to one end of the mandrel. The mandrel and assembled plastic sleeve is designed to fit inside a conventional pump barrel mounted in the downhole casing and reciprocates within the barrel to pump water, oil and/or condensate from a down-hole interval or formation to the surface. The plastic sleeve is typically constructed of a rigid, ultra-high molecular weight polyethylene cylinder, with one or two, typically brass, inserts tightly mounted in the plastic seal bore to control thermal expansion in the plastic seal.

It has surprisingly been found that rigid cylindrical plastic sleeves may be fitted with one or more metal inserts for expansion control purposes and mounted on a conventional or specially designed pump mandrel for sealing the resulting pump plunger or traveling valve in the barrel of a downhole water or liquid hydrocarbon pump. In a most preferred embodiment the plastic sleeve is characterized by a cylindrical, ultra-high molecular weight polymer such as polyethylene, sleeve having an internal bore and a wall thickness sufficient to impart rigidity, and the insert is one or more brass, copper, stainless steel or other preferably flanged, metal fitting sized to tightly fit inside the polyethylene sleeve bore and stabilize the polyethylene sleeve against excessive sleeve expansion in the pump barrel as a result of high formation temperatures and friction-induced heat. The mandrel typically includes a ball and seat valve on one end, as well as one or more lock nuts and, optionally, one or more fiber washers and metal rings for holding the fiber washers in place, depending upon the nature and condition of the water or hydrocarbon fluid being pumped from the producing zone or interval.

One of the problems which exists in conventional downhole or well pumps is that of effectively sealing the pump plungers inside the corresponding pump barrels during reciprocation of the plungers inside the barrels, while operating the pump to pump water or hydrocarbons to the surface under a wide variety of fluid contamination. Various types of seals, including o-rings, packing and other seals well known to those skilled in the art have been used in an attempt to increase the efficiency of the pumping operation and prevent "blow back" of production fluid, as well as operate to handle sand and other impurities in the pumped well fluid. Regardless of the type of seals or packing used to prevent, or at least minimize, loss of pumping efficiency due to these undesirable conditions in the well, the pump must be periodically pulled from the well and the seals and/or packing frequently replaced at great expense in labor and material.

A common technique for sealing plungers inside the barrels of downhole pumps is by means of flexible and resilient fiber or plastic cups and rings that are designed to traverse the inside surface of the pump barrel during reciprocation of the pump plunger and insure optimum production of well fluid. However, water and hydrocarbon contaminants such as sand and other bits of material from the producing internal and well frequently cut the flexible fiber or plastic cups and drastically reduce pumping efficiency. Furthermore, when the well is "pulled" during maintenance and the pump is thus removed from the well, these flexible and resilient sealing cups tend to further tear or otherwise disintegrate and must be replaced. Moreover, the conventional cups and rings wear significantly during reciprocation of the plunger inside the pump barrel, even under ideal conditions and the pumping efficiency goes steadily down due to this wear, thus necessitating frequent maintenance of the well.

2. Description of the Prior Art

Various types of pump plungers have been devised by those skilled in the art to solve, or at least minimize, the problem of excessive wearing of seals and frequent maintenance of downhole pumps. U.S. Pat. No. 5,120,203, dated Jun. 9, 1992, to Ronald A. Priestly, details a "Universal Plunger For Oil Well Pumps", which plunger includes a symmetrical plunger body having a longitudinal bore, a pair of threaded flange nipples projecting from end flanges located on each end of the plunger body, a pair of spaced o-ring seats provided inwardly of the end flanges, respectively, the O-rings seated in the o-ring seats, a plunger body segment of reduced diameter extending between the inner sets of O-rings and a "Teflon"-hydrocarbon composition disposed between the spaced inside O-rings, the plunger body segment and that portion of the inside surface of the oil well pump barrel which faces the plunger body segment for sealing and lubricating the universal plunger in the pump barrel. U.S. Pat. No. 5,196,108, dated Mar. 23, 1993, to Thomas S. Wilmeth, et al, details a "Sucker Rod Oil Well Pump and Method of Operation". The method details a technique for constructing portions of a sucker rod pump of the type having a steel plunger with an exterior cylindrical wall and a barrel with a cylindrical bore. A chromium case is formed on the cylindrical bore to a selected depth for receiving the plunger in sliding contact. The chromium case is formed by forming a base electrolyte bath, including water, chromic acid, a sulfate compound, an alkyl sulfonic acid and an anion of molybdenum. The bore is exposed to the aqueous electrolyte bath of selected current density and a plating temperature sufficient to form a chromium deposit of desired thickness on the bore. A process for manufacturing composite pipes is detailed in U.S. Pat. No. 4,743,329, dated May 10, 1988, to Hata. Improved composite pipes manufactured by the process of this invention include an outer pipe made of plastic and a thin lead layer on the inner wall of the outer pipe. The lead layer is formed by arranging a lead pipe in the outer pipe and expanding it by pressure into close contact with the inner wall of the outer pipe. The outer pipe may be circular, square or double-path. U.S. Pat. No. 5,255,294, to Bierwirth, dated Oct. 19, 1993, details a "Sealing Device For Cylindrical Hollow Bodies" with an opening at an end face, especially for sealing pump sockets in the interior of reactor containers. The sealing device has a cylindrical sealing insert with two axially displaceable members and an elastic sealing ring disposed between the members. A displacement of the members toward one another results in an enlargement of an outer diameter of the sealing ring and contact pressure between the outer circumference of the sealing ring and the inner wall surface of the hollow body. A remote-controlled placing tool is connectable to the sealing insert for clamping and locking the sealing insert in a sealing position and for releasing the sealing insert therefrom. The tool has a clamping cylinder with a clamping piston and a clamping piston rod in the form of a hollow cylinder connected to the clamping piston. A clamping anchor is connected to the first co-axial member and a sleeve is connected co-axially and slidably about the anchor. U.S. Pat. No. 5,344,678, dated Sep. 6, 1994, to Kagiwara, et al. details a "Shaft Sleeve Made of Ceramics". The ceramic shaft sleeve is provided in confrontation with a stationary sliding member and a sliding bearing or plain bearing. The shaft sleeve includes a cylindrical body made of ceramics and having a circular outer surface and a circular inner surface, with an elastic member molded on the inner surface of the cylindrical body and formed with an inner opening having a shape corresponding to the cross-section of a shaft. An "Apparatus For Sealing An Oil Well Pump Polished Rod" is detailed in U.S. Pat. No. 4,345,766, to Turanyi. The apparatus has a tubular housing adaptor for securing to a wellhead of an oil well for sealing a reciprocating oil well pump polished rod extending through the tubular housing. The housing is formed in two operating tubular portions that are connected to enable limited angular movement therebetween, but which are resiliently urged to maintain a longitudinal alignment of the two portions. Multiple, longitudinally-spaced packing rings carried in one of the housing portion effects engagement of the wellhead leakage blocking seal with the reciprocating polish rod. Upper and lower rod scrapers protect the spaced seals from contact with undesired foreign matter that may be carried by the polished rod or that will damage the seals. A pair of guide bushings located adjacent the seals maintain the longitudinal alignment of the seal carrying housing portion with the polished rod.

It is an object of this invention to provide a new and improved plunger or traveling valve for a downhole or well pump and particularly, an oil well pump, which plunger is characterized by a mandrel and at least one cylindrical plastic seal having at least one metal insert for mounting on the mandrel and sealing the plunger in the barrel of the pump.

Another object of this invention is to provide a new and improved plunger for a downhole water or oil well pump, which plunger is characterized by an elongated mandrel of selected design, length and diameter, at least one cylindrical plastic sleeve fitted with one or more metal inserts, mounted on the mandrel for sealing the pump plunger inside the barrel of the downhole pump and one or more fiber rings and ring holders for wiping the barrel during operation of the pump.

Still another object of this invention is to provide a new and improved, thermally stabilized sleeve seal polymer for mounting on the mandrel of a downhole pump plunger by means of one or more metal inserts and sealing the pump plunger for reciprocation in the barrel of a downhole well pump.

A still further object of this invention is to provide a new and improved, rigid, cylindrical, ultra-high molecular weight polyethylene sleeve seal fitted with one or more metal inserts for mounting on the mandrel element of a pump plunger, defining creep slots and/or wet seal spaces between the sleeve seals and sealing the plunger in the barrel of a downhole oil well pump.

SUMMARY OF THE INVENTION

These and other objects of the invention are provided in a new and improved plunger or traveling valve for a water well pump or an oil well tubing or insert pump, which plunger is characterized by an elongated mandrel of selected design, diameter and length and having a ball and seat valve on at least one end and at least one ultra-high molecular weight polyethylene plastic sleeve seal fitted with one or more oversized flanged or unflanged metal inserts, mounted on the mandrel for selectively creating creep slots and/or wet seal spaces between the sleeve seals and sealing the plunger in reciprocating fashion inside the barrel of the oil well pump. The plastic sleeve seal receives one or two metal inserts to control or limit thermal expansion in the plastic and, if flanged and oversized with respect to the sleeve seals, create a wet seal space for trapping sand and well fluid debris and/or a creep slot for effecting linear, rather than radial, thermal expansion in the plastic sleeve seal. One or more fiber rings and fiber ring holders, as well as one or more mounting nuts for securing the plastic sleeve seal or seals, fiber ring holders and fiber rings in place, may also be provided on the mandrel, as deemed necessary for specific well conditions.

BRIEF DESCRIPTION OF THE DRAWING

The invention will be better understood by reference to the accompanying drawings, wherein:

FIG. 7 is a perspective view of a typical rigid cylindrical plastic sleeve for sealing the plunger of a downhole pump;

FIG. 8 is a perspective view of the plastic sleeve illustrated in FIG. 7 with a pair of metal inserts mounted therein for controlling thermal expansion of the plastic sleeve during service;

FIG. 9 is a partially exploded, sectional view of a typical assembly of a pair of plastic sleeves with accompanying metal inserts and accessory fiber rings and metal rings arranged for assembly on a mandrel to define the plunger and seal elements of a downhole pump according to the invention; and FIG. 10 is a perspective view of a second preferred embodiment of the plastic sleeve illustrated in FIG. 7.

DESCRIPTION OF THE PREFERRED EMBODIMENTS

Figure 1:
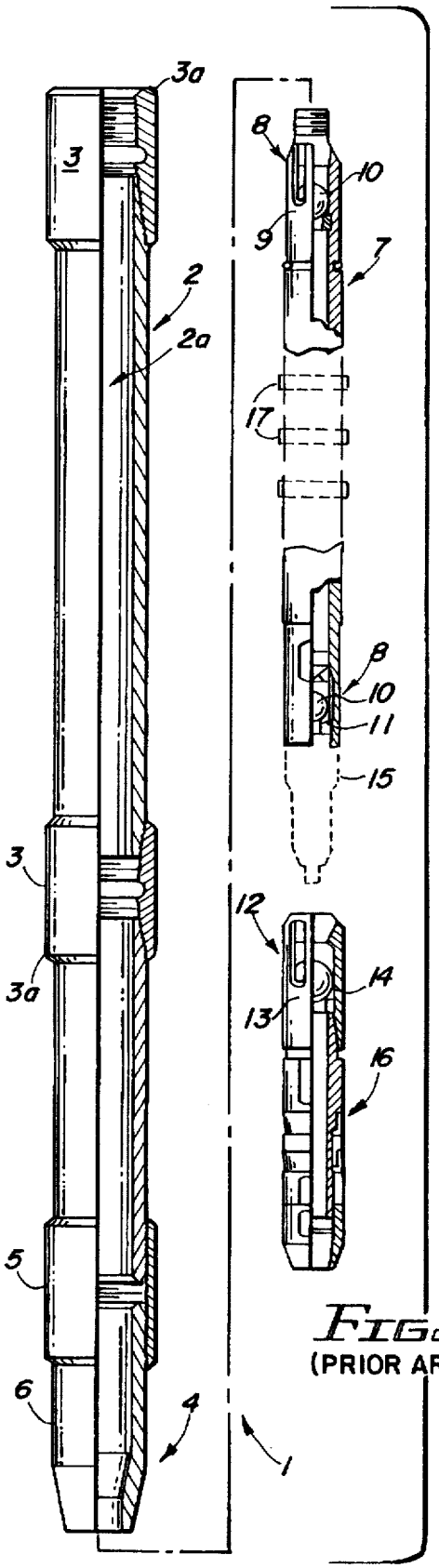
FIG. 1 (PRIOR ART)
FIG. 1 is a perspective view, partially in section, of a conventional downhole oil well cup and ring pump.

Referring initially to FIG. 1 of the drawings, a typical cup and ring pump, the design of which is well known to those skilled in the art, is generally illustrated by reference numeral 1. The cup and ring pump 1 includes a cylindrical pump barrel 2, having a longitudinal pump barrel bore 2*a* and fitted with barrel couplings 3 at the top and center thereof. The bottom tubing coupler 5 couples an extension nipple 4 to the pump barrel 2 and the extension nipple 4 further includes a sealing nipple 6. The cup and ring pump 1 also includes a conventional reciprocating soft packed and/or metal plunger 7, fitted with sealing cups 17 and a ball and seat valve 8 at each end, the top ball and seat valve 8 further including an open-top cage 9, which receives the travelling ball 10. The bottom ball and seat valve 8 is characterized by a plunger cage 11, also having a travelling ball 10 and a standing valve puller 15, detailed in phantom, is connected to the lower end of the soft packed and/or metal plunger 7. A conventional seating cup 16 is designed for insertion in the pump barrel 2 beneath the soft packed and/or metal plunger 7 and includes a standing valve 12, having a standing valve cage 13 and a ball 14, located in the standing valve cage 13.

Referring now to FIGS. 2, 2A, 9 and 10 of the drawings, the plunger of this invention is generally illustrated by reference numeral 18 and is characterized by an elongated cylindrical mandrel 23 of suitable design, length, material of construction and diameter for a selected specific well or downhole pump service. The mandrel 23 is typically constructed of bronze or brass and may be conventional in design with a ball and seat valve 8 threaded on the mandrel threads 24 in conventional fashion. The mandrel threads 24 are provided on both ends of the mandrel 23, not only for mounting the ball and seat valve 8, but also for receiving one or more mounting nuts 25 or other equipment, according to the knowledge of those skilled in the art. A pair of plastic sleeves 19 are each fitted with a pair of sleeve inserts 27, each of which sleeve inserts 27 is further characterized by a cylindrical sleeve insert tube 28, which fits snugly in the internal sleeve bore 22 of the plastic sleeve 19, and an optional tube flange 30 that seats against the top sleeve edge 20 and bottom sleeve edge 21 of each plastic sleeve 19, as illustrated. Each of the tubular sleeve inserts 27 is typically characterized by metal construction such as brass, stainless steel or the like and is designed to tightly fit inside the internal sleeve bore 22 of the plastic sleeves 19 to stabilize plastic sleeves 19 against thermal expansion, as hereinafter further described.

Figure 2A:
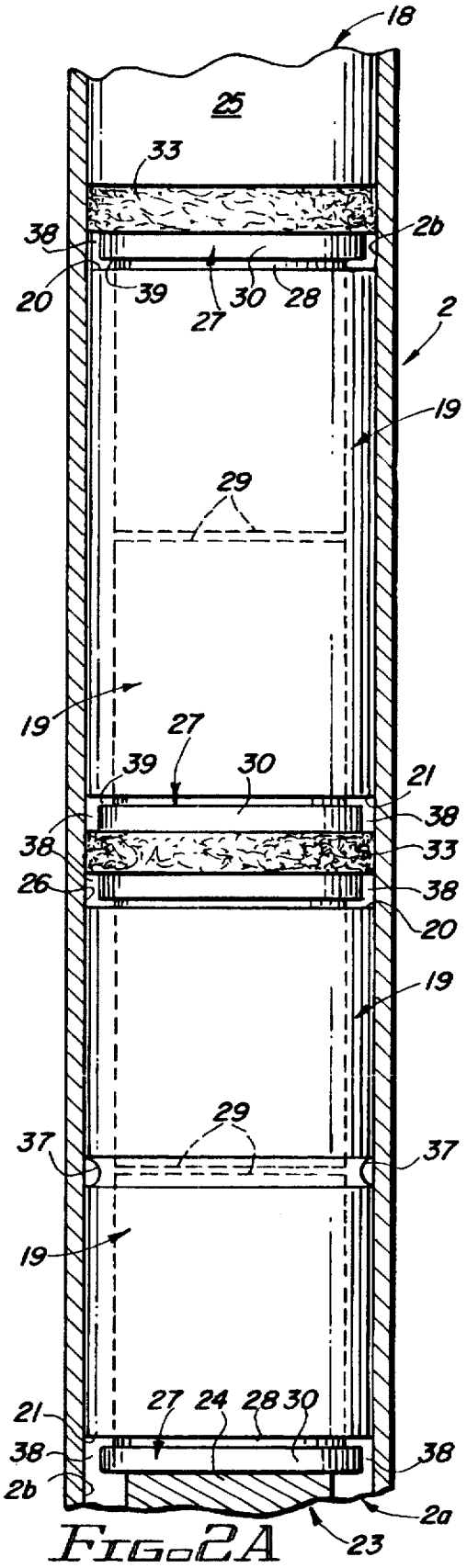
FIG. 2A is a sectional view of a preferred embodiment of the plunger and seal mounted in a conventional plunger barrel according to this invention.

In a most preferred embodiment of the invention the tube edges 29 of the sleeve insert tubes 28 abut each other approximately halfway into the internal sleeve bore 22 of the plastic sleeves 19, respectively. Furthermore, in another preferred embodiment the optional tube flange 30 of each of the sleeve insert tubes 28 is smaller in diameter than the outside diameter of the plastic sleeve 19, thus leaving an annular space between the tube flanges 30 and the internal barrel surface **2*b* of the pump barrel 2 when the mandrel 23 and accompanying plastic sleeves 19, fitted with the sleeve inserts 27, are assembled on the mandrel 23 in the manner illustrated in FIGS. 2A and 9. This annular space is defined as a wet seal space 38 and is designed to trap sand and other foreign particles and debris which may be present in the well fluid flowing from the interval and pumped by the plunger 18 from the interval through the pump barrel 2 in conventional fashion. A creep slot 39 may also be defined in the sleeve insert 27-plastic sleeve 19 design, under circumstances where the sleeve insert tubes 28 of the respective sleeve inserts 27 are oversized in length, as illustrated in FIGS. 2A and 9. This disparity in length between the sleeve insert tubes 28 and plastic sleeves 19 allows linear, rather than radial, thermal expansion of the plastic sleeves 19. Furthermore, one or more fiber rings 33 may also be provided on the mandrel 23 in combination with or in lieu of fiber ring holders 34, having ring holder extensions 35, as illustrated in FIG. 9. The fiber rings 33 are conventional in design and serve to wipe the internal barrel surface 2*b* of the pump barrel 2 clear of foreign objects, including sand and other well interval particles, which may be abrasive and tend to damage the plastic sleeve 19. However, it will be appreciated by those skilled in the art that the plastic sleeves 19** are designed to effect embedment of any such abrasive particles such as sand, in the plastic without adversely affecting pumping efficiency, as hereinafter described.

Referring now to FIGS. 2A and 3–7 of the drawings, the sleeve inserts 27 are each characterized by a stiff or rigid cylindrical sleeve insert tube of suitable thickness, terminating at a tube edge 29 at one end and, in one embodiment, a tube flange 30 at the other. In a first preferred embodiment of the invention a pair of sleeve inserts 27 are inserted in the internal sleeve bore 22 of each plastic sleeve 19, with the tube edges 29 abutting approximately in the center of the plastic sleeve 19, as illustrated in phantom in FIG. 2A. One or more fiber rings 33 and fiber ring holders 34 can also be positioned on the mandrel 23 in the manner illustrated in FIGS. 2 and 2A and as further illustrated in FIG. 3. It has surprisingly been found that insertion of the sleeve insert or inserts 27 inside the respective rigid plastic sleeves 19 serves to thermally stabilize the plastic sleeves 19, which would otherwise expand due to pumping friction and elevated formation temperatures to an undesirable extent and "seize" the plunger 18 inside the pump barrel 2. Expansion of the plastic sleeves 19 and insertion of the respective sleeve insert tubes 28 of the sleeve inserts 27 into the plastic sleeves 19 can be effected by liquid baths, convection heating or by other techniques known to those skilled in the art, thereby raising the temperature of the plastic sleeve to a suitable level, expanding the plastic sleeves 19 and slightly enlarging the internal sleeve bore 22. The respective sleeve insert tubes 28 are then inserted in the internal sleeve bores 22 of the respective heated plastic sleeves 19 and when the plastic sleeves 19 cool and contract, the respective sleeve insert tubes 28 are firmly and securely positioned inside the corresponding internal sleeve bores 22 of the plastic sleeves 19, with the tube edges 29 abutting therein.

Figure 2:
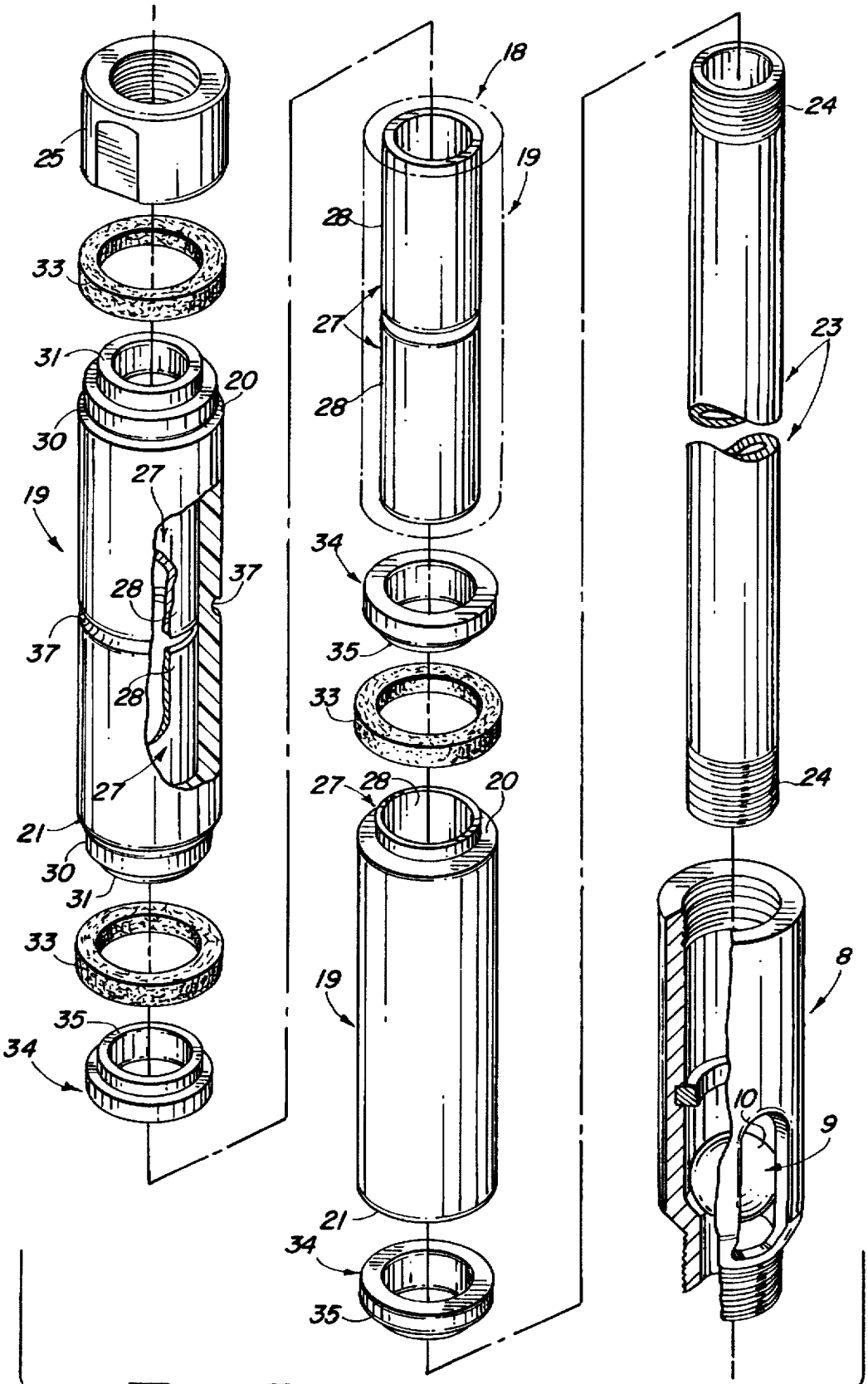
FIG. 2 is an exploded view of a typical embodiment of the plunger and seal for a well pump of this invention.
Figure 3:
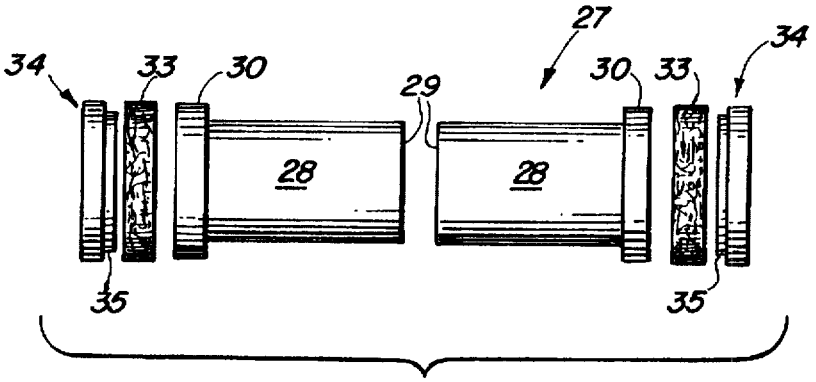
FIG. 3 is an exploded view of a first preferred metal insert configuration for fitting inside the plastic sleeve element of this invention.
Figure 4:
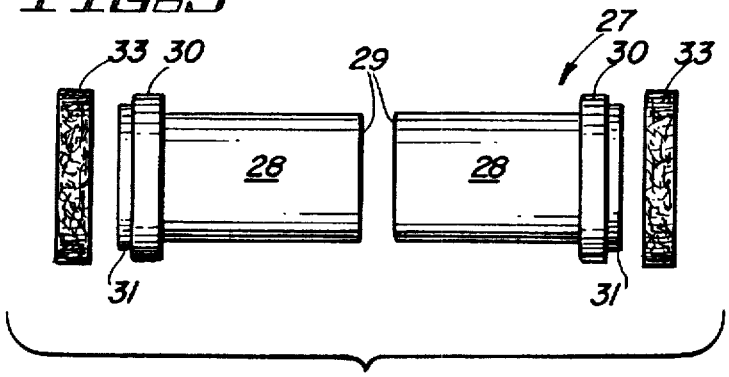
FIG. 4 is an exploded view of an alternative metal insert configuration.

Referring now to FIGS. 2 and 4 of the drawings, in another preferred embodiment of the invention a tube flange extension 31 is machined or molded in the tube flange 30 of each of the sleeve inserts 27 to receive and stabilize the fiber rings 33, a configuration which eliminates the need for the fiber ring holders 34. Furthermore, as illustrated in FIG. 2, lower center of the drawing, a fiber ring holder 34 may be mounted on the mandrel 23 without a fiber ring 33 to define an additional wet seal space 38 (illustrated in FIG. 2).

Figure 5:
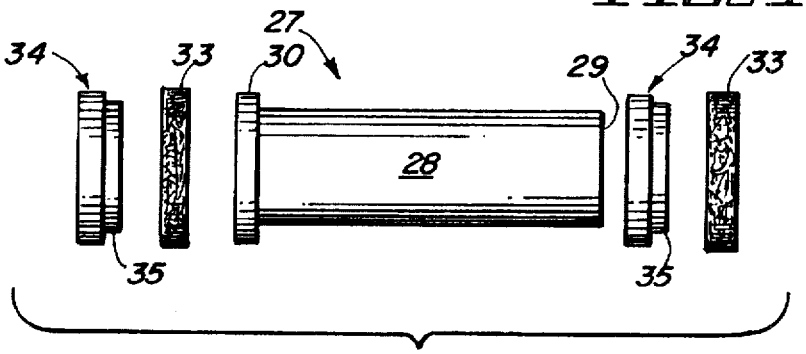
FIG. 5 is an exploded view of yet another metal insert configuration for the plastic sleeve of this invention.
Figure 6:
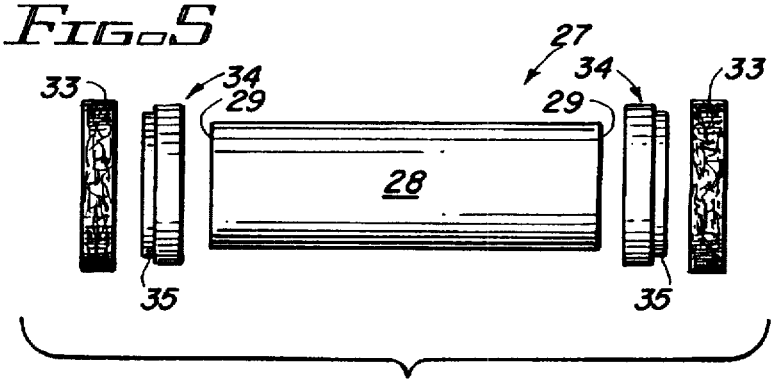
FIG. 6 is an exploded view of still further preferred configuration for the metal insert.

Referring to FIGS. 5 and 6 of the drawings, in yet another preferred embodiment of the invention a single sleeve insert 27 is provided with a sleeve insert tube 28 which is substantially equal in length to, or slightly longer than, the internal sleeve bore 22 of the corresponding plastic sleeve 19. Accordingly, a fiber ring holder 34 may be positioned on the mandrel 23 adjacent to the tube edge 29 of the sleeve insert 27 after the sleeve insert tube 28 of the sleeve insert 27 has been inserted in the corresponding internal sleeve bore of the plastic sleeve 19, as heretofore described. The fiber ring holder 34 may also include a ring holder extension 35 for receiving a fiber ring 33. Similarly, the opposite end of the sleeve insert 27, which is fitted with tube flange 30, is positioned adjacent to another fiber ring 33 which is seated on a corresponding ring holder extension 35 of a second fiber ring holder 34, as illustrated.

Referring now to FIGS. 2, 2A, 6 and 7 of the drawings, in yet another preferred embodiment of the invention the sleeve insert 27 is characterized by a sleeve insert tube 28 which has no tube flange 30 and is designed to be inserted inside the internal sleeve bore 22 of a plastic sleeve 19, with a pair of fiber ring holders 34 serving as tube flanges 30. Accordingly, the fiber ring holders 34 are positioned such that the respective ring holder extensions 35 face outwardly for receiving a corresponding fiber ring 33 and are designed to seat against the extending tube edges 29 of the sleeve insert tube 28 when the sleeve insert tube 28, fiber ring holders 34 and fiber rings 33 are mounted on the mandrel 23 as illustrated in FIGS. 2 and 2A.

As further illustrated in FIG. 9, three plastic sleeves 19, with oversized sleeve inserts 27, may be arranged on the mandrel 23 such that two of the tube edges 29 abut between the respective top sleeve edge 20 and bottom sleeve edge 21 of the two adjacent plastic sleeves 19. This arrangement creates a wet seal space 38 of selected width between the plastic sleeves 19. Accordingly, it will be appreciated by those skilled in the art that many variations of the sleeve insert 27 may be provided to thermally stabilize the plastic sleeve 19 and this thermal stability as a function of temperature is demonstrated in the following table:

| TEMPERATURE | PLASTIC SLEEVE DIAMETER (WITHOUT INSERT | PLASTIC SLEEVE DIAMETER (WITH INSERT |
|---|---|---|
| 97° | 2.245 o.d. | 2.245 o.d. |
| 105° | 2.248 o.d. | 2.246 o.d. |
| 135° | 2.253 o.d. | 2.248 o.d. |
| 150° | 2.257 o.d. | 2.250 o.d. |
| 170° | 2.260 o.d. | 2.251 o.d. |

It will be understood that the above table is illustrative of thermal expansion of a typical virgin ultra high molecular weight polyethylene sleeve having a molecular weight in the range of from about 2 million to about six million. Thermal expansion in the plastic sleeve fitted with the insert is considerably less than that without the insert, as shown in the table. It is further understood that other formulations of plastic, including polyethylene, can be used in various pump sealing services, depending upon the thermal characteristics of the service. The molecular weight of these polymers may vary considerably from the above delineated illustrative range.

As described above, it will be appreciated that the sleeve insert 27 component of this invention can be constructed of substantially any metal which is sufficiently chemically resistant to the water or hydrocarbon fluid being pumped, and has sufficient structural integrity to maintain the cylindrical configuration when subjected to shrinkage of the plastic sleeve 19 thereon. For example, brass, stainless steel and like metals, in non-exclusive particular, can be used to construct the sleeve inserts 27 in the various configurations illustrated in the drawings. Not only does the sleeve insert 27 operate to control thermal expansion in the corresponding plastic sleeves 19, but it also operates to effect a precision fit of the plastic sleeves 19 to the mandrel 23 and to keep the plastic sleeves 19 uniform in configuration according to applicable manufacturing standards. For example, the oversized sleeve insert 27 is designed to prevent the plastic sleeve 19 from being warped or otherwise damaged when the plastic sleeve or sleeves 19 are secured on the mandrel 23 by means of the mounting nut 25, since the sleeve insert tubes 28 may be longer than the plastic sleeves 19. The sleeve inserts 27 also serve to facilitate convenient and easy mounting and disassembly of the respective plastic sleeve or sleeves 19 to and from the mandrel 23 and the specific shape of the sleeve insert 27 is designed to facilitate the wet seal spaces 33 and/or creep slots 39 illustrated in FIGS. 2 and 2A, as heretofore described.

The plastic sleeves 19 can be constructed of substantially any plastic material, including thermoplastic and thermosetting resins and polymers, depending upon service temperature requirements. A preferred material of construction is ultra-high molecular weight polyethylene having a molecular weight of from about 2 million to about 6 million, although various other polymers, including polyethylene, polypropylene and polyolefins, and particularly, polyolefins having ultra-high molecular weights, may be used to construct the sleeves of this invention. The various plastics which are suitable for use in the invention may be injection-molded, extruded and compression molded, in non-exclusive particular. Such plastics as low density and high density polyethylene, with a preferred ultra-high molecular weight polyethylene, both virgin (natural) and regrind formulations, are particularly well suited for use in the invention, as well as the doubly-oriented polymers disclosed in U.S. Pat. No. 5,049,347 to Joseph H. Magill, et al. These polymers, including various polyolefins, are well suited for use in the invention since the thermal expansion characteristics of such polymers can be controlled advantageously for use in applicant's plunger. The polyethylene plastic sleeves 19 may also be constructed of both virgin (natural) and regrind (recycle) polyethylene formulations, as well as polyethylene and other polymers, including polyolefins, having special additives to improve desirable properties or suppress undesirable properties to produce the desired minimum thermal expansion service capability. The plastic sleeves 19 are characterized by a low coefficient of friction and can be machined or molded to precisely fit the pump barrel 2 and receive the respective sleeve inserts 27 to control thermal expansion. Because of such a precision fit and low coefficient of friction, the plastic sleeves 19 furnish a desirable substitute for traditional and conventional cups in cup and ring pumps, since foreign particles that typically damage these flexible cups will easily embed in the plastic sleeves 19, thus minimizing damage to the pump barrel 2 during reciprocation of the plunger 18 inside the pump barrel 2. Furthermore, this embedment of sand and other foreign material in the plastic sleeves 19 does not impede sealing of the plunger 18 of the pump barrel 2 by means of the plastic sleeves 19. Moreover, the plastic sleeves 19 serve to eliminate conventional cups, compression rings, rag rings, packing and other conventional equipment used to seal the plungers of downhole pumps in the respective pump barrels. The plastic sleeves 19 can be constructed of any desired length and serve to further eliminate metal plungers under circumstances where temperature is not a factor and the service is at a temperature not exceeding material limits.

It will be appreciated by those skilled in the art that a primary advantage of the plunger 18 and the plastic sleeve 19 and sleeve insert 27 components of the plunger 18 is to provide a downhole pump which may be used in an oil well, gas well or water well to produce oil, condensate or water. It is believed that this is an original application of extruded, machined or compression or injection-molded polymers in this type of downhole pumping application because of the known thermal expansion characteristics of these plastics. Accordingly, the sleeve inserts 27 mounted in the plastic sleeves 19 as described above surprisingly control the thermal expansion of the plastic sleeves 19 to a manageable level and provide a precision fit to the mandrel 23 when installed to define the plunger 18 of this invention. Furthermore, the pumping efficiency of the downhole pump when utilizing the plunger 18 of this invention is greater than conventional pumps and will not significantly deteriorate over a period of time. For example, during tests of a downhole sucker rod pump in which a plunger 18 of this invention was installed, it was found that a pump which formerly produced 321 barrels per day using the old cup and ring downhole pump elements was increased to 342 barrels per day, an increase of 21 barrels per day, with greatly extended pump life and efficiency.

It will be further appreciated by those skilled in the art that the plastic sleeves 19 and sleeve insert 27 combination, in selected lengths and material of construction, can be used on a conventional or specially designed mandrel 23 of suitable size and length to define a plunger 18 which may also incorporate multiple fiber rings 33 and fiber ring holders 34, depending upon the nature and character of the well fluid pumped from the producing sand or interval. For example, under circumstances where there is considerable sand and/or other abrasive particles or debris produced from the producing sand or interval and well, which debris is entrained in the well fluid, a greater number of fiber rings 33 and fiber ring holders 34 may be utilized to minimize the quantity of these particles which may come into contact with the plastic sleeve or sleeves 19 during the pumping operation. However, this problem is also minimized by structuring and spacing the plastic sleeves 19 and internal sleeve inserts 27 and using only the fiber ring holders 34 to create one or more wet seal spaces 38 which entrap these particles and further prevent particle migration into the plastic sleeves 19, as described above. The plastic sleeves 19 may also be fitted with one or more of the wet seal grooves 37 illustrated in FIG. 10 to achieve the same result. Moreover, as described above, it will be appreciated by those skilled in the art that even if some of the sand or other gritty or abrasive particles escape wiping and entrapment by the fiber rings 33 and the wet seal spaces 38, as well as the wet seal grooves 37, since the plastic sleeves 19 are relatively soft, the gritty material tends to embed in the plastic sleeves 19 and minimize damage to the metal pump barrel 2 in which the plunger 18 reciprocates. The result is that use of the plastic sleeves 19 and cooperating sleeve inserts 27 on the mandrel 23 to define the traveling valve or plunger 18 facilitates a pump which does not have to be redressed each time the well is "pulled" or maintained. Furthermore, the plastic sleeves 19 are inert, very resilient, rigid, impact-resistant and therefore have an extended life expectancy and high efficiency over conventional pumps such as the cup and ring type pumps, for example. The plunger and seal of this invention therefore conserves energy over a long period of pumping time and reduces lifting costs due to reduced friction in the pump.

Still another advantage of the plastic sleeve 19 and sleeve insert 27 combination in the plunger 18 of this invention is to serve as a barrel guide to keep the traveling valve or plunger 18 centralized in the pump barrel 2 and facilitate uniform wear on all sides and surfaces of the plastic sleeves 19, as well as the other pump elements contacting the pump barrel 2 as the plunger 18 reciprocates in the pump barrel 2.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A plunger disposed for reciprocation in a pump barrel and pumping fluid through the pump barrel, said plunger comprising a mandrel; at least one valve means provided on said mandrel for selectively channeling the fluid through said mandrel and the pump barrel; at least one elongated metal insert of substantially uniform diameter throughout its length mounted on said mandrel; and at least one cylindrical plastic sleeve mounted on said insert for engaging the pump barrel in sealing relationship with respect to the pump barrel for sealing said plunger in the pump barrel.

2. The plunger of claim 1 wherein said at least one valve means comprises a single valve means.

3. The plunger of claim 1 comprising at least one fiber ring holder mounted on said mandrel and at least one fiber ring means seated on said fiber ring holder, whereby said fiber ring means wipes the pump barrel responsive to reciprocation of said plunger in the pump barrel.

4. The plunger of claim 1 comprising flange means provided on said insert and wherein said insert is no longer than said cylindrical plastic sleeve to define a creep slot between said cylindrical plastic sleeve and said flange means on said insert.

5. The plunger of claim 4 comprising at least one fiber ring holder mounted on said mandrel and at least one fiber ring means seated on said fiber ring holder, whereby said fiber ring means wipes the pump barrel responsive to reciprocation of said plunger in the pump barrel and wherein said at least one valve means comprises a single ball and seat valve.

6. The plunger of claim 1 comprising at least one wet seal groove provided in the circumference of said cylindrical plastic sleeve for trapping debris present in the well fluid.

7. The plunger of claim 6 comprising at least one fiber ring holder mounted on said mandrel and at least one fiber ring means seated on said fiber ring holder, whereby said fiber ring means wipes the pump barrel responsive to reciprocation of said plunger in the pump barrel.

8. A plunger disposed for reciprocation in the pump barrel of a downhole pump and pumping well fluid through the pump barrel, said plunger comprising an elongated mandrel; at least one ball and seat valve provided in said mandrel for selectively directing the well fluid through said mandrel and the pump barrel; at least one substantially cylindrical metal insert removably disposed on said mandrel and a substantially cylindrical flange provided on one end of said metal insert; and a substantially cylindrical plastic sleeve tightly mounted on said metal insert, said plastic sleeve having substantially cylindrical sleeve edges at each end thereof, wherein said sleeve edges are larger in diameter than said flange to define a wet seal space between said flange, said sleeve edges and the pump barrel, whereby said plastic sleeve seals said plunger in the pump barrel and said wet seal space traps debris present in the well fluid.

9. The plunger of claim 8 comprising at least one fiber ring holder mounted on said mandrel and at least one fiber ring means seated on said fiber ring holder, whereby said fiber ring means wipes the pump barrel responsive to reciprocation of said plunger in the pump barrel.

10. The plunger of claim 8 wherein said at least one ball and seat valve comprises a single ball and seat valve disposed at one end of said mandrel.

11. The plunger of claim 8 wherein said plastic sleeve is shorter than said metal insert to define a creep slot between said sleeve edges of said adjacent ones of said plastic sleeve and said flange for accommodating thermal expansion in said plastic sleeve.

12. The plunger of claim 8 comprising a ring holder extension provided on said flange and at least one fiber ring means mounted on said ring holder extension, whereby said fiber ring means wipes the pump barrel responsive to reciprocation of said plunger in the pump barrel.

13. The plunger of claim 12 wherein said at least one metal insert comprises two metal inserts and said plastic sleeve is shorter than said metal inserts to define a creep slot between said sleeve edges of said adjacent ones of said plastic sleeve and said flange for accommodating thermal expansion in said plastic sleeve.

14. A seal for sealing a plunger having a mandrel in the barrel of a well pump, said seal comprising at least one elongated, tubular metal insert mounted on said mandrel and at least one tubular plastic sleeve means mounted on said insert for slidably engaging the barrel, wherein at least one end of said insert projects from said tubular plastic sleeve means for defining a wet seal space between adjacent ones of said tubular plastic sleeve means, whereby said tubular plastic sleeve means seals the plunger in the barrel at least during reciprocation of the plunger in the barrel.

15. The seal of claim 14 wherein said tubular plastic sleeve means comprises a cylindrical plastic sleeve tightly fitted to said insert.

16. The seal of claim 14 wherein said at least one tubular metal insert comprises a pair of tubular metal inserts fitted in each end of said tubular plastic sleeve means.

17. The seal of claim 16 wherein said tubular plastic sleeve means comprises a cylindrical plastic sleeve tightly fitted to said pair of tubular metal inserts.

18. The seal of claim 14 comprising a flange provided on at least one end of said tubular metal insert for spacing said tubular plastic sleeve means on said plunger.

19. The seal of claim 18 wherein said at least one of said tubular metal inserts is longer than said tubular plastic sleeve means for shaping a creep slot between said flange and said tubular plastic sleeve means.

20. The seal of claim 18 wherein said flange is smaller in diameter than the diameter of said tubular plastic sleeve means for shaping a wet seal space between adjacent ones of said tubular plastic sleeve means and said flange when said seal is mounted on said plunger.

21. The seal of claim 18 wherein:

(a) said at least one of said tubular metal insert is longer than said tubular plastic sleeve means for shaping a creep slot between said flange and said tubular plastic sleeve means; and (b) said flange is smaller in diameter than the diameter tubular plastic sleeve means for shaping a wet seal space between adjacent ones of said tubular plastic sleeve means and said flange when said seal is mounted on said plunger.

* * * * *